US005207762A

United States Patent [19]

Newman

[11] Patent Number: 5,207,762

[45] Date of Patent: May 4, 1993

[54] QUICK COOLING APPARATUS AND METHOD

[75] Inventor: Arnold L. Newman, Kensington, Md.

[73] Assignee: Synexas Corporation, Bethesda, Md.

[21] Appl. No.: 754,623

[22] Filed: Sep. 4, 1991

[51] Int. Cl.[5] ..... F25B 41/00

[52] U.S. Cl. ..... 62/419; 62/62

[58] Field of Search ..... 62/62, 404, 405, 417, 62/419, 457.1, 457.4

[56] References Cited

U.S. PATENT DOCUMENTS 3,998,072 12/1976 Shaw ..... 62/457.4

4,358,932 11/1982 Helfrich, Jr. ..... 62/419 X 4,468,932 9/1984 Bullard ..... 62/457.1 X 4,485,641 12/1984 Angelier et al. ..... 62/419 X 4,681,611 7/1987 Bohner ..... 62/457.4 X

*Primary Examiner*—John C. Fox

[57] ABSTRACT

This invention relates to an apparatus and method for increasing the cooling rate of an item and its contents within a refrigeration system. The item is held in a housing that also includes a motor driven fan. The apparatus containing the item to be cooled is placed in a refrigeration system and the motor driven fan moves cold air from the refrigeration system through the housing, thereby quickly and favorably cooling the item.

9 Claims, 2 Drawing Sheets

QUICK COOLING APPARATUS AND METHOD

BACKGROUND OF THE INVENTION

1. Field of the Invention

This invention relates to an apparatus and method for cooling items within refrigeration systems. In particular, this apparatus and method favorably cool an item quicker than the refrigeration system can alone.

2. Description of the Related Art

U.S. Pat. No. 4,681,611 discloses a device and process for maintaining a bottle of wine at a predetermined temperature while the wine is being served. The device is operated in the ambient environment near the point of wine consumption. It can be used either by itself to cool the wine bottle from ambient temperature or to maintain the temperature of a wine bottle that has previously been cooled.

U.S. Pat. No. 4,468,932 discloses a portable ice chest with racks and trays for food and beverages, replaceable ice cubes as cooling elements, and a battery powered, motor driven fan. This ice chest is a self contained refrigeration system with its own ice compartment as a cooling means.

OBJECTS OF THE INVENTION

An object of the present invention is to increase the cooling rate of an item when it is placed in a refrigerator, freezer, cooler or the like.

A further object of the present invention is to cool a specific item in a refrigeration system more efficiently and quickly than if the refrigeration system itself were solely relied upon to cool the item.

Another object of the present invention is to directly and controllably cool an item for a measured amount of time within a cooling chamber.

An additional object of the invention is to provide an indication of when an item has been cooled for a predetermined amount of time.

SUMMARY OF THE INVENTION

There is a need to quickly cool items in refrigeration systems. In particular, there is a need for an apparatus and method that, when used in conjunction with a refrigeration system, will more favorably and quickly cool an item. For example, many people put items such as warm cans of soda or beer in a refrigerator, a cooler, or a freezer to cool. Unfortunately, if one has not planned ahead and cooled the desired item in advance, one must patiently endure thirst and wait for the item to cool to a refreshing and appealing temperature. It is useful and desirable to have a portable apparatus for use within the refrigeration system to increase the cooling rate of a specific item and for making it more refreshing and appealing when it is removed from the refrigeration system and consumed. This apparatus cools the item quicker and more favorably than if the item were placed in the refrigeration system without the apparatus. There are other examples of this need to cool items quickly. In addition to cooling such consumable items such as cans and bottles of beverages, the concept of increasing the cooling rate of a particular item within a refrigeration system can be used for quickly and efficiently cooling food and other consumables, and making ice cubes.

The apparatus of the present invention uses the cold air of a refrigeration system to favorably and quickly cool an item. It concentrates the cooling power of the refrigeration system by focusing and directing a stream of cold air from the refrigeration system against an item and thus makes better and more efficient use of the cold air for cooling a specific item. In particular, it is a portable apparatus that receives and holds the item to be cooled, and blows and circulates the cold air around and against the item so that the item is contacted by the blown cold air. Because of the movement of the cold air, air contacting the item is continually refreshed. The apparatus supplements and enhances the cooling action of a refrigeration system. For example, it is not convenient or sufficient to place an item to be cooled in the path of moving air from the integral fan inlet into the cooling compartment of a refrigeration system. This air stream will not be focused or directed against a specific item, and, if the refrigeration system is full of other items, it could be blocked. Furthermore, refrigeration systems go through different cycles, including defrost cycles.

In the present invention a motor driven fan is used for moving the cold air and an on/off switch is provided. The item to be cooled is held within the apparatus. For example, it is held by supports and flexible elements such as a spring or springs configured to receive and contact the item, but other forms of support can also be used. These supports and flexible elements can be of a metallic or other heat conducting material, and are connected to the housing of the apparatus, which itself may be of a metallic or other heat conducting material. The supports and flexible elements maintain the item to be cooled in a spaced relationship with the inner surface of the housing. Furthermore, this configuration allows the free movement and circulation of air both around and against the item, as well as around and against the supports and flexible elements, and the inner surface of the housing. With this apparatus an item is cooled directly by cold air contacting its surface. It is also cooled by loss of heat by conduction through the elements with which the item's surface is in contact. These elements are themselves cooled by contact with the cold, moving air, and they include the supports and flexible elements. These elements are also connected to the housing (which is itself contacted by the cold, moving air) and as such, benefit from the housing's ability to dissipate heat.

For cooling large items such as wine bottles, the item is held within a flexible housing such as a sack. The sack, made of plastic, cloth or other compliant material, is closed around the item, and cold air of the refrigeration system is blown through the sack and around the item by a motor driven fan. The item within the sack is maintained in complete or partial spatial relationship with the sack by the movement of the air, which inflates the sack.

By quickly cooling water, the apparatus of the present invention is used to make ice and ice cubes quickly and efficiently. In this application, water is put directly into the housing, which is configured as an ice or ice cube tray. Cold air from the refrigeration system is blown and circulated by the motor driven fan within the housing, and around and against the water to be frozen.

When it is desired to use the apparatus in a freezer to quickly cool an item such as a beverage, there is the possibility of the item freezing. To avoid this problem, the apparatus can be provided with a timer and an alarm so the item can be removed before it freezes.

DETAILED DESCRIPTION OF THE PREFERRED EMBODIMENTS

Figure 1:
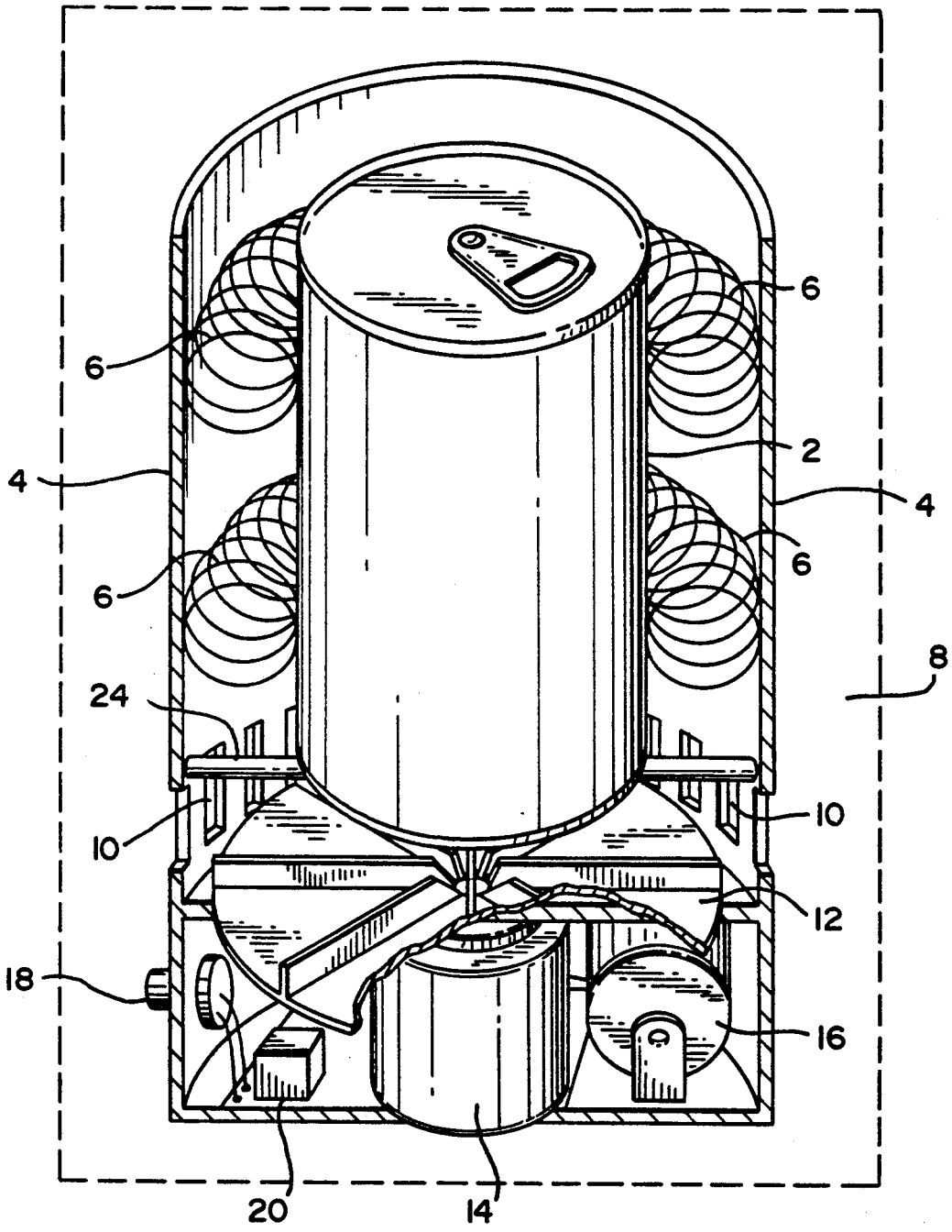
FIG. 1 is a general view, partly in section, illustrating the present invention.

A major use for the apparatus and method of the present invention is to cool items within refrigeration systems more quickly than they would cool if they were simply placed in the refrigeration system without benefit of the present invention. In FIG. 1, for purposes of illustration, the item to be cooled, 2, is shown as a can of beverage. However, it could be a bottle of beverage or other consumable, or, more generally, a glass, cup, jar, or other container or item, and the contents therein. In the present invention, the term "item" is used to mean either an item and/or an item and its contents. Item 2 is placed in housing 4, and is separated from the inner surface of housing 4 by flexible elements 6, which hold item 2 in a spaced relationship with the inner surface of housing 4. In the preferred embodiment, flexible elements 6 are metallic, spiral springs disposed circumferentially concentric to the inner surface of housing 4, and are attached thereto. Flexible elements 6 are chosen so that they present a minimum of resistance to air movement. In this arrangement, flexible elements 6 serve to hold item 2 in place, and also provide a heat conductive path between item 2 and the inner wall of housing 4. This has the effect of extending the heat dissipating surface for cooling item 2. In operation, cold air from within the refrigeration environment 8 is moved from the top of housing 4, down through the space between item 2 and the inner surface of housing 4 as defined by flexible elements 6 and out through vent holes 10 by centrifugal blower wheel fan 12 driven by motor 14. Item 2 is prevented from touching the blower wheel fan 12 by support 24, which holds item 2 in a spaced relationship with blower wheel fan 12. Motor 14 is powered by battery 16, and the apparatus is switched on and off by switch 18. Timer alarm 20 sounds after a preset period of operation. In operation, cold, moving air from within the refrigeration environment 8 and moved by centrifugal blower wheel fan 12, contacts item 2, flexible elements 6, and housing 4. Thus, item 2 is cooled by cold air contacting it, and by heat conduction through flexible elements 6 into housing 4, which are themselves cooled by cold air.

Figure 2:
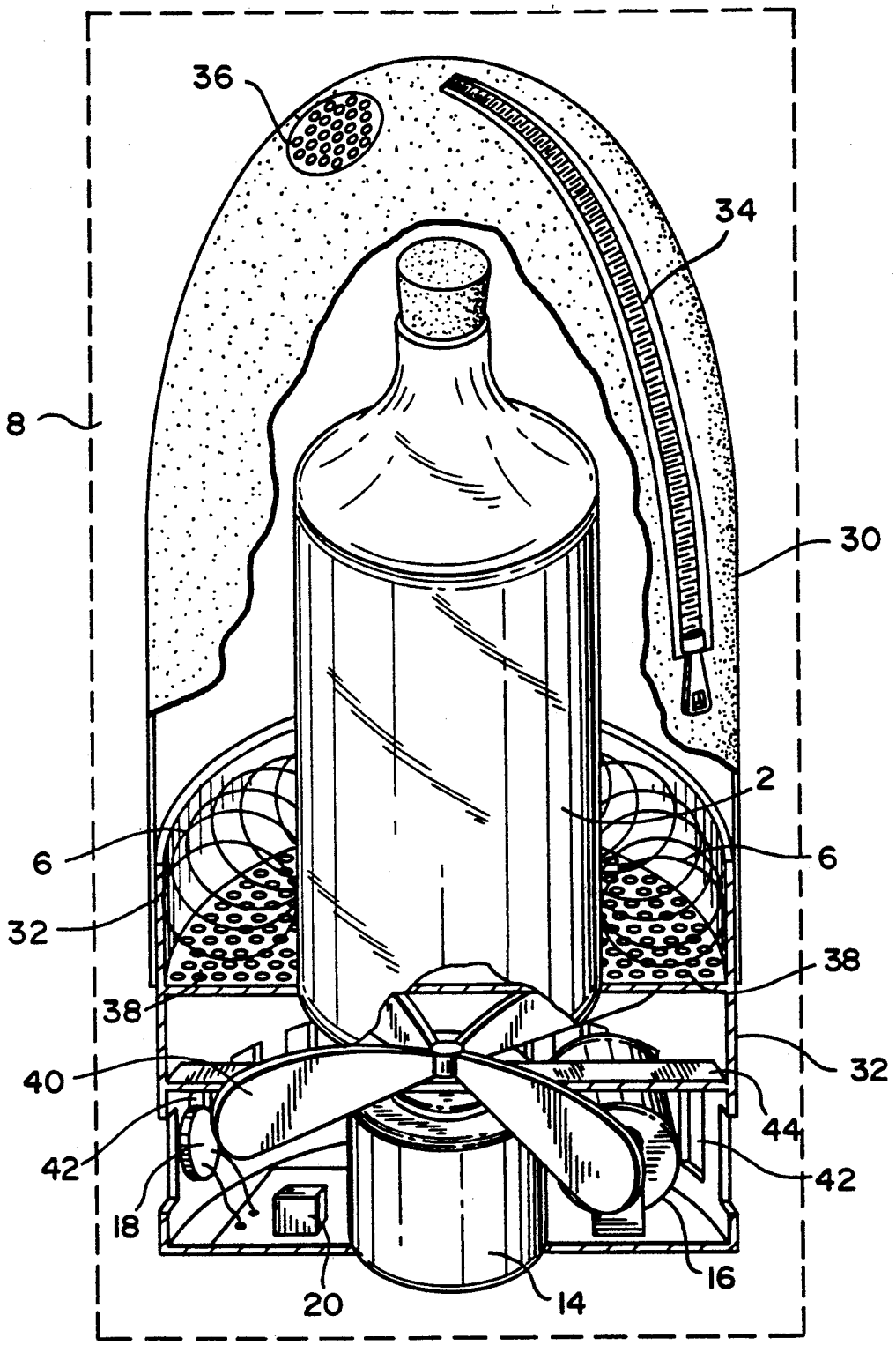
FIG. 2 is a general view, partly in section, of another embodiment of the apparatus in accordance with this invention.

FIG. 2 illustrates another embodiment of the present invention. Here the item to be cooled, 2, is a large bottle such as a wine bottle. This embodiment includes a sack 30 that covers the item to be cooled from the top of housing 32. The sack is opened and closed with zipper 34, and a venting port 36 is provided in sack 30. Item 2 is held in spaced relationship with the inner surface of housing 32 by flexible element 6. Flexible element 6 is shown as a metallic spiral spring disposed circumferentially concentric to the inner surface of housing 32. Item 2 is supported by mesh support 38 in spaced relationship with fan propeller 40, which is supported by bracket 44. In operation, propeller fan 40 driven by motor 14 blows a stream of cold air from the refrigeration environment 8 into housing 32 and sack 30, thereby inflating sack 30 and causing item 2 to be in a spaced relationship with the inner surface of sack 30. Moving air enters housing 32 through vent holes 42, is propelled by motor 14 driven propeller fan 40 through mesh support 38, and moves in the space between item 2, and the inner surface of sack 30. Air leaves sack 30 through venting port 36. Air also leaves sack 30 through the porosity of zipper 34, and any other porosities in the sack 30. The apparatus is switched on and off by switch 18. Timer alarm 20 sounds after a preset period of operation.

The particular elements of the embodiments are given as examples only. Variations of these elements are useful within the scope of the present invention.

Flexible elements 6, for example, can be configured as vertical strips of spring metal, attached at their tops and bottoms to the inner surface of the housing and bowing out at their centers to receive the item 2 in tight contact. Generally, flexible elements 6 will have a deformable curve aspect configured to receive and hold the item and exert pressure thereupon. Other spring configurations known in the art will also perform the holding, spacing, and heat conduction functions adequately.

A variety of fans known in the art can be used for moving cold air in this invention. For example, the propeller fan 40 of the embodiment of FIG. 2 can be used in the housing 4 of the embodiment of FIG. 1 to move cold air up or down through the housing 4. Centrifugal blower fans, propeller fans, impeller fans and axial fans as well as others in general are also applicable for air moving purposes of this invention.

The invention described is not intended to be limited to the embodiments disclosed but includes modifications made within the true spirit and scope of the invention.

I claim:

1. An apparatus for portable use within a refrigeration system for increasing the cooling rate of an item comprising:

(a) a housing for removable placement within said refrigeration system for receiving and holding said item therein in at least partially spaced relationship with an inner surface of said housing;

(b) a fan positioned within said refrigeration system in conjunction with said housing for moving cold air from said refrigeration system through said housing, said cold air contacting said item.

2. The apparatus as recited in claim 1 further comprising a thermally conductive flexible element connected to said inner surface of said housing for receiving and holding said item and defining said spaced relationship between said item and said inner surface and wherein said thermally conductive flexible element is contacted by said moving cold air and is thereby cooled.

3. The apparatus as recited in claim 1 wherein said housing is thermally conductive and wherein said thermally conductive housing is contacted by said moving cold air and is thereby cooled.

4. The apparatus as recited in claim 1 wherein said housing is flexible.

5. The apparatus as recited in claim 4 wherein said item is held in at least partially spaced relationship with inner surface of said flexible housing by air itself.

6. The apparatus as recited in claim 5 further comprising a timer alarm for indicating a preset period of cooling.

7. A portable apparatus for use within a refrigeration system for increasing the cooling rate of an item comprising:

(a) a housing having an inner surface;

(b) at least one thermally conductive flexible element connected to said inner surface of said housing for receiving and holding said item and defining an at least partially spaced relationship between said item and said inner surface;

(c) a fan positioned in conjunction with said housing for moving cold air from said refrigeration system through said housing, said cold air contacting and thereby cooling said item and said thermally conductive flexible element.

8. A method for increasing the cooling rate of an item within a refrigeration system, comprising the steps of:

(a) placing into said refrigeration system said item and its contents in a portable housing having a fan and at least one flexible element adapted to receive and contact said item;

(b) moving cold air from said refrigeration system against said item by use of said fan thereby cooling said item and its contents and said flexible element;

(c) removing said item and said housing from said refrigeration system.

9. The method as recited in claim 8 further comprising the step of providing a timer alarm for indicating a preset period of cooling.

* * * * *